US007024812B2

(12) United States Patent
Nelson

(10) Patent No.: US 7,024,812 B2
(45) Date of Patent: Apr. 11, 2006

(54) GUN STOCK PIVOT

(76) Inventor: James B. Nelson, P.O. Box 913, Marysville, WA (US) 98270

( * ) Notice: Subject to any disclaimer, the term of this patent is extended or adjusted under 35 U.S.C. 154(b) by 0 days.

(21) Appl. No.: 10/860,685

(22) Filed: Jun. 3, 2004

(65) Prior Publication Data

US 2005/0268516 A1 Dec. 8, 2005

(51) Int. Cl.
*F41C 23/14* (2006.01)

(52) U.S. Cl. ..... 42/73

(58) Field of Classification Search ..... 42/73
See application file for complete search history.

(56) References Cited

U.S. PATENT DOCUMENTS 3,052,053 A * 9/1962 Vartanian ..... 42/13
3,388,494 A * 6/1968 Kimball ..... 42/74
5,225,613 A * 7/1993 Claridge ..... 42/74
5,351,428 A * 10/1994 Graham ..... 42/72

* cited by examiner

*Primary Examiner*—Troy Chambers
(74) *Attorney, Agent, or Firm*—Jensen & Puntigam PS

(57) ABSTRACT

A mechanism, which may be integral with the gun parts or may be manufactured as an after-market item, which permits the butt of a shoulder-fired weapon to be pivoted about an axis substantially parallel to the axis of the gun barrel.

4 Claims, 5 Drawing Sheets

GUN STOCK PIVOT

TECHNICAL FIELD

This invention relates to shoulder-fired weapons, and in particular to an improvement which allows the user to pivot the butt of a shoulder-fired weapon relative to the receiver portion about a longitudinal axis, which extends substantially parallel to the barrel of the gun, permitting the rapid use of more than one mounted sight, or in the alternative, reduces the profile of the weapon when used in tight spaces.

BACKGROUND OF THE INVENTION

It has long been known that certain combat conditions subject the combatants to varying situations, requiring the rapid use of more than one sight or zero to accommodate for the conditions, such as when adapting for shooting in a horizontal plane to shooting at a steep angle, the utilization of day and night sights, or alternatively, when shooting from a crowded, cramped, protected position.

Historically, these varying conditions of combat engagement have been met by utilizing different weaponry, a situation which is unrealistic in most conditions, or in the alternative, utilizing quick exchange sighting mechanisms, which require the user to take the gun off target to exchange the sight, a time-consuming and perhaps life-endangering diversion.

SUMMARY OF THE INVENTION

With the above-noted prior art in mind, it is a benefit of the present invention to provide a gun, including a butt, which is pivotable about an axis substantially parallel to the gun barrel, allowing the rotation of the receiver and the utilization of more than one sight already mounted upon the gun.

It is a further benefit of the present invention to provide a mechanism wherein the gun butt can be temporarily secured to the receiver at an angle different from the angle normally associated with the gun butt.

It is a further advantage of the present invention to provide a mechanism wherein the gun butt may be easily moved about an axis substantially parallel to the gun barrel axis and locked in place.

Yet another benefit is to provide a gun which is capable of being aimed and discharged with the butt at varying angles relative to the receiver.

Still a further benefit is to provide a device which allows the conversion of a gun from a fixed butt to one which is relatively movable and indexed.

BEST MODE FOR CARRYING OUT THE INVENTION

Figure 1:
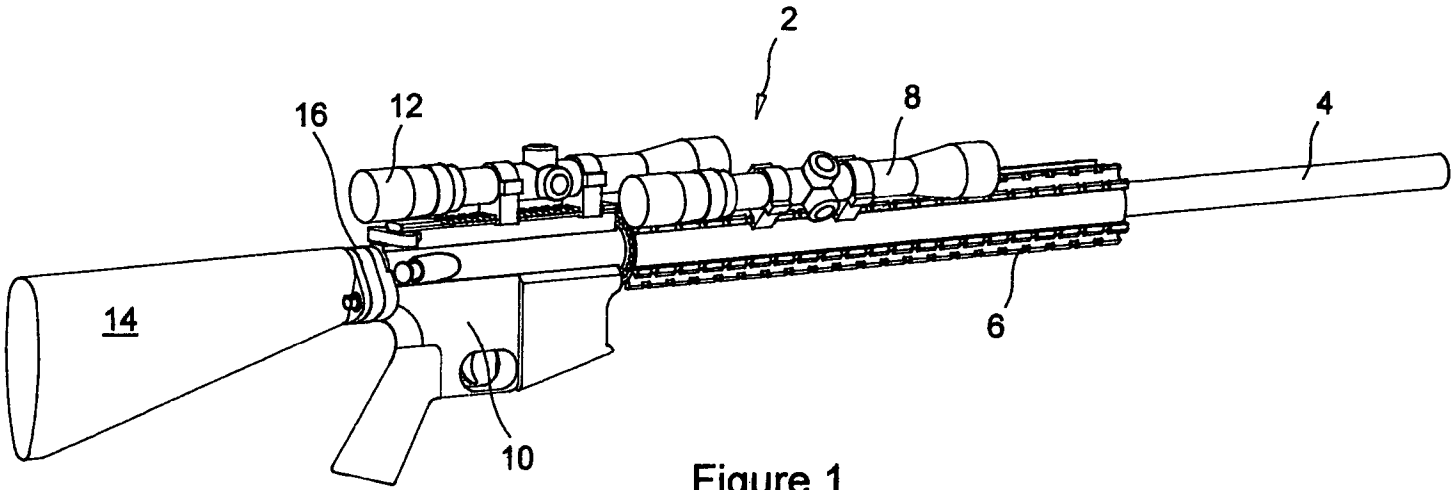
FIG. 1 is an isometric view of a standard rifle, incorporating the inventive Stock Pivot Adapter.

As seen in FIG. 1, a rifle 2 includes a barrel 4 to which is secured the tubular hand guard 6 upon which is mounted sight 8, a receiver mechanism 10, containing the necessary mechanism and supporting the trigger mechanism 10 and a second sight 12. The gun terminates in a butt 14. It is to be noted that the receiver mechanism 10 is physically separated from the butt 14 by the inventive Stock Pivot Adapter 16, as explained hereinafter.

Figure 2:
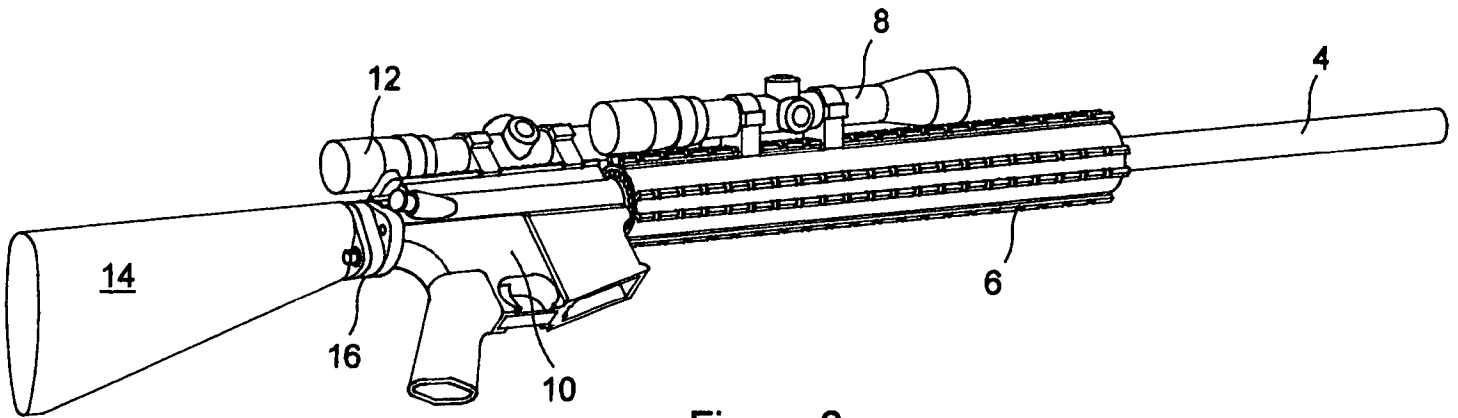
FIG. 2 is an isometric view of the rifle of FIG. 1 with the butt rotated relative to the remainder of the gun.

Reference is now had to FIG. 2, wherein it can be seen that the receiver mechanism 10 and all of the mechanisms secured thereto are then rotated through and indexed at an angle with respect to the butt, such that the sight 8 is now in the position of choice for a shooter having the butt 14 firmly against the shoulder, and the cheek likewise pressing and stabilizing against the butt.

Although the current invention is described as an adapter and is described with respect to an AR15 rifle, it is fully understood that the present invention could be utilized as both an integral part of an OEM assembly and as a conversion accessory, and further, could be used with any one of a number of weapons or weapon replicas which are shoulder-fired. Since the AR15 was selected for the purpose of this disclosure, its components are likewise adapted to the invention. In particular, a straight line runs from the upper region of the rifle's butt plate to the muzzle of the rifle, forming a linear axis. Within the rifle's butt is a hollow tube through which the bolt carrier travels in and out along the linear axis during the discharging of the rifle. The linear axis of the rifle design is the foundation for this particular inventive adapter. The hollow tube is used as the axis of rotation for the adapter and attached receiver. It is also to be understood that because of the fact the adapter adds slightly to the length of the butt by moving it rearwardly along the spring tube, a spacer and longer screw are needed.

Figure 3:
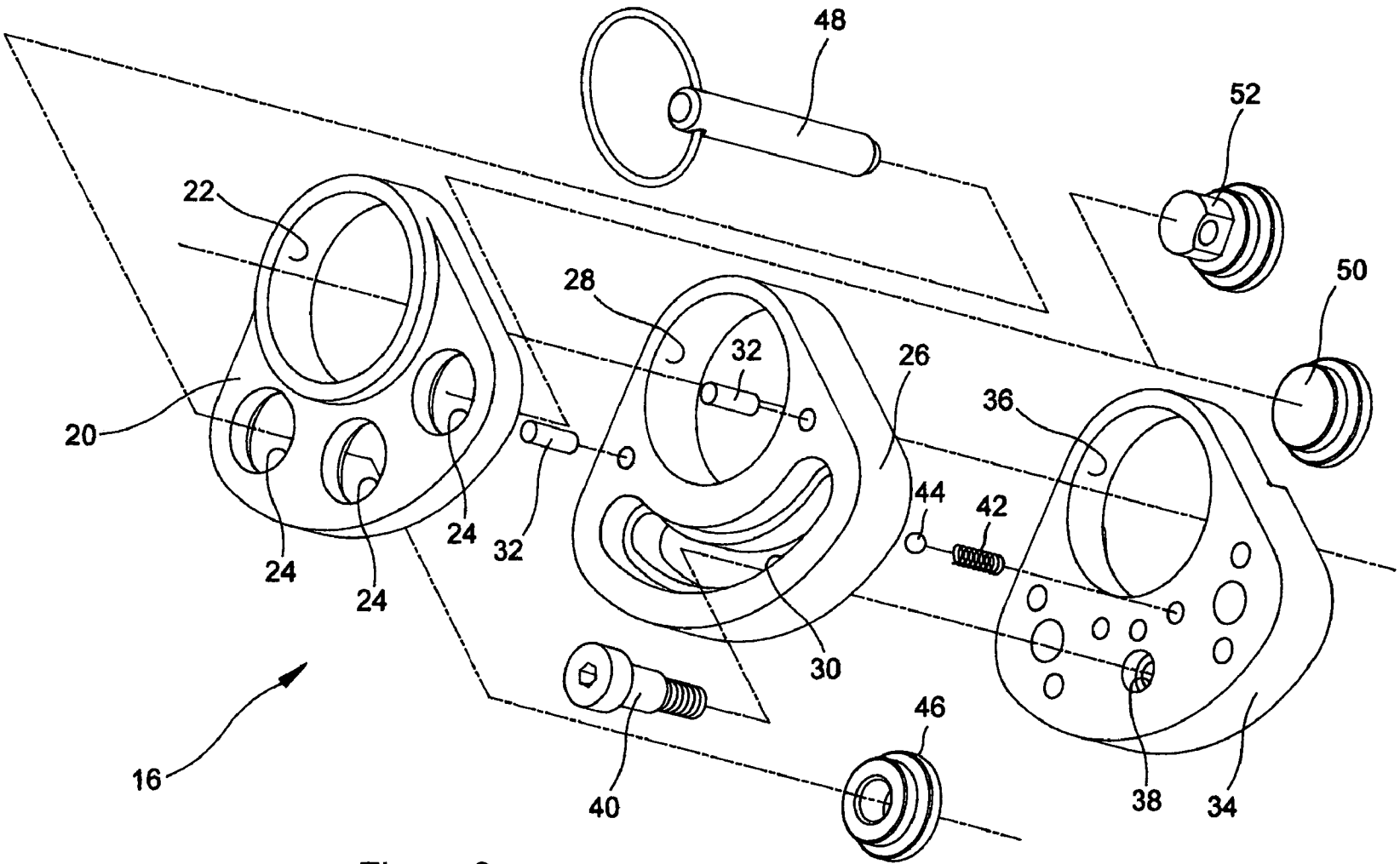
FIG. 3 is an exploded view of the Stock Pivot Adapter as viewed from the butt end.

Reference is now had to FIG. 3, and it can be seen that the illustrative adapter comprises multiple elements, including a first unit 20 which includes a bore 22 to receive an axial element as well as multiple separate bores 24, located along a circumference about the axis of rotation.

Adjacent to element 20 is element 26 of identical exterior profile and including a bore 28 to receive an axial element and an arcuate slot 30, and when assembled element 26 is locked to element 20 by means of two dowel pins 32.

Another element 34 likewise includes a bore 36 to receive an axial element, and includes a threaded bore to receive a shoulder bolt 40 to secure the units together and yet allow relative rotation as the shoulder bolt 40 extends through and is moved along the arcuate slot 30. Spring/s 42 and ball/s 44 captured between elements 26 and 34, as explained hereinafter, allow the elements to move relative to one another and yet to be indexed. Likewise as seen in this view are an optional locking pin disc 46 to be inserted in one of the holes 24 to receive the optional locking pin 48, plug disc/s 50 to seal holes 24 which are not in use and an optional swivel attachment 52, which provides an optional place for the securement of a sling swivel.

Figure 4:
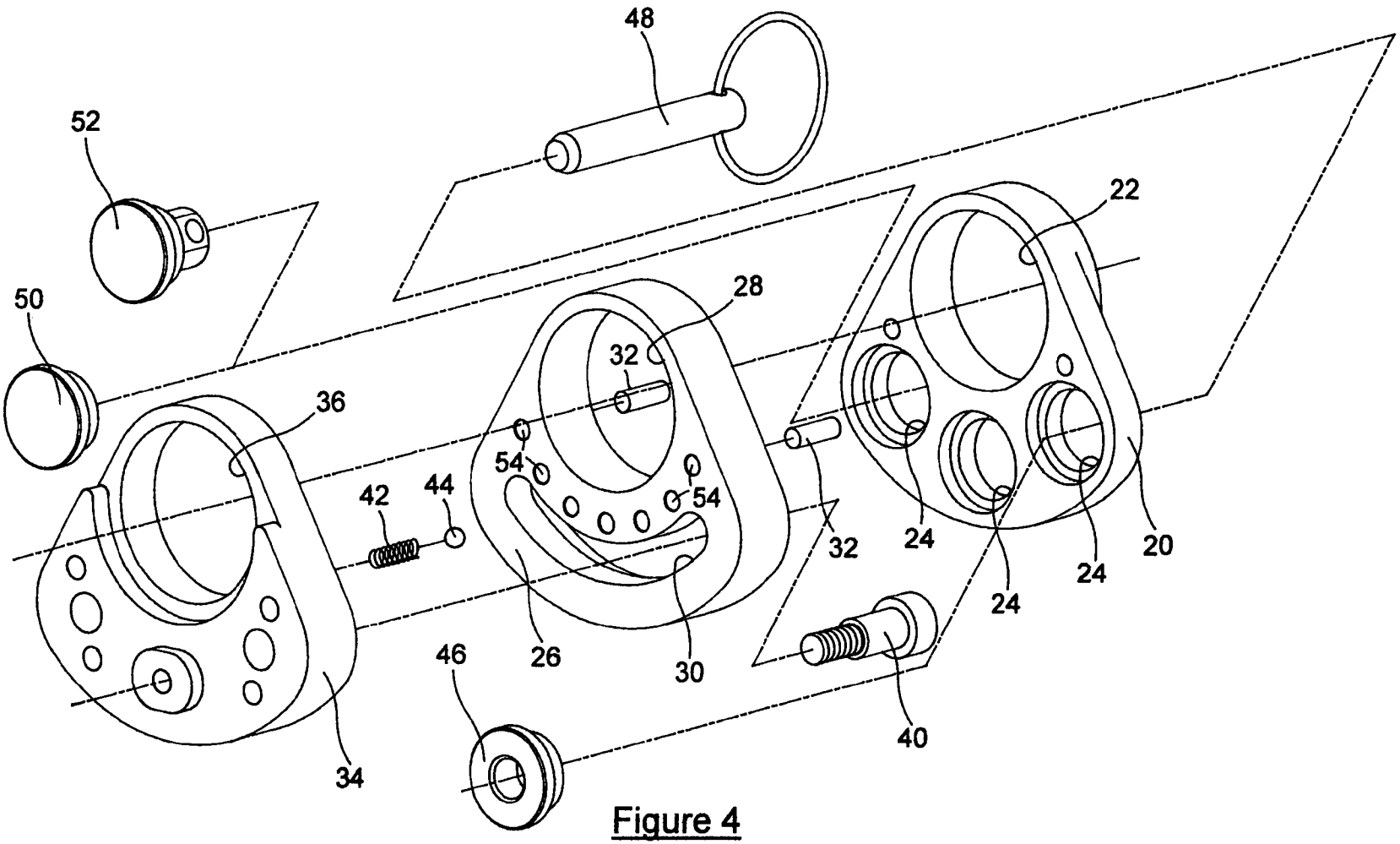
FIG. 4 is an exploded view of the Stock Pivot Adapter as viewed from the receiver end.

In addition to what has been shown and described with respect to FIG. 3, FIG. 4 also shows the detents 54 to receive ball/s 44 when the device is indexed.

Figure 5:
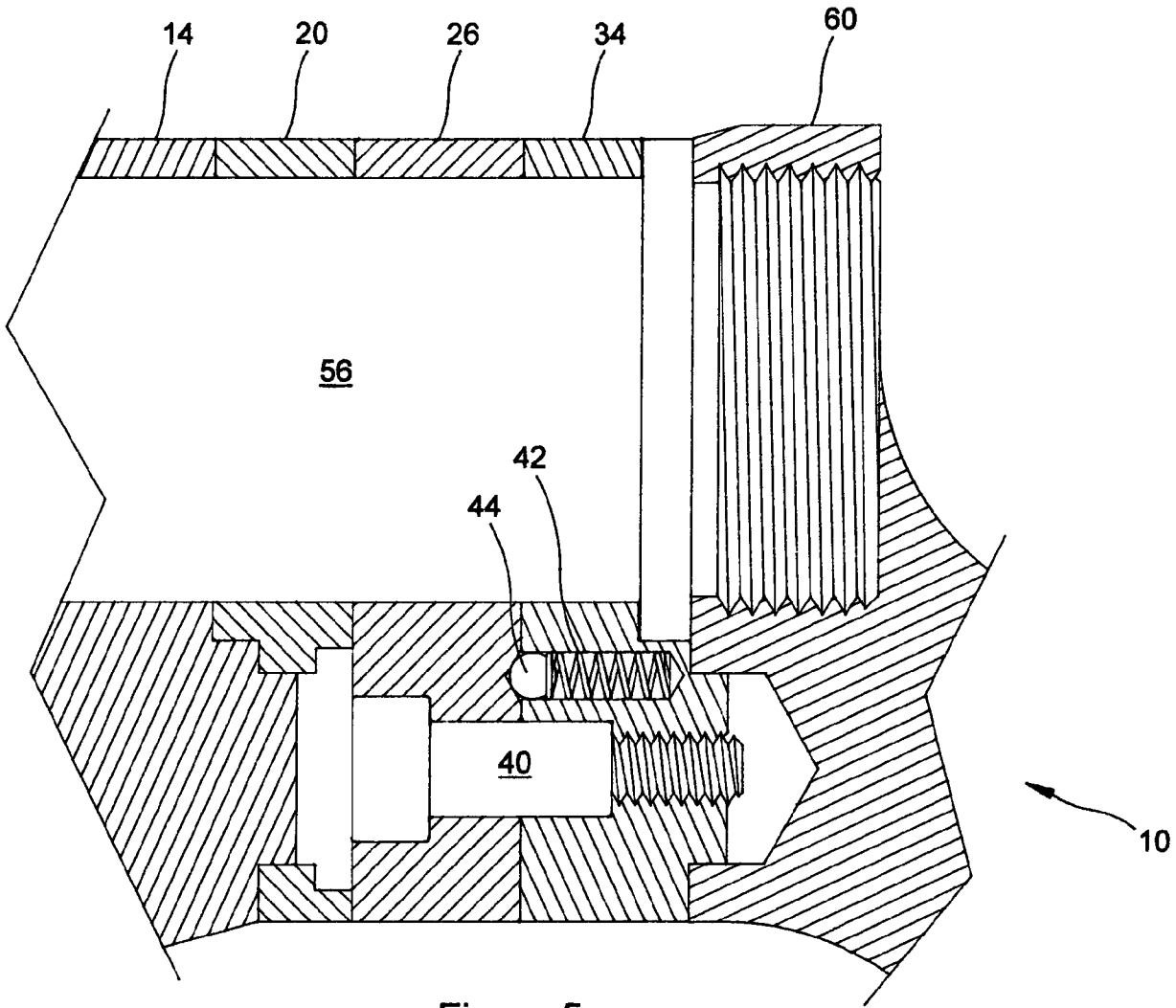
FIG. 5 is a sectional view through the inventive Stock Pivot Adapter when secured in position between the butt and the receiver.

Reference is now had to FIG. 5, wherein the individual elements are shown in their assembled condition, captured and contained in a co-axial relationship by spring tube 56 which is threaded into the receiver 60 of the gun.

Figure 6:
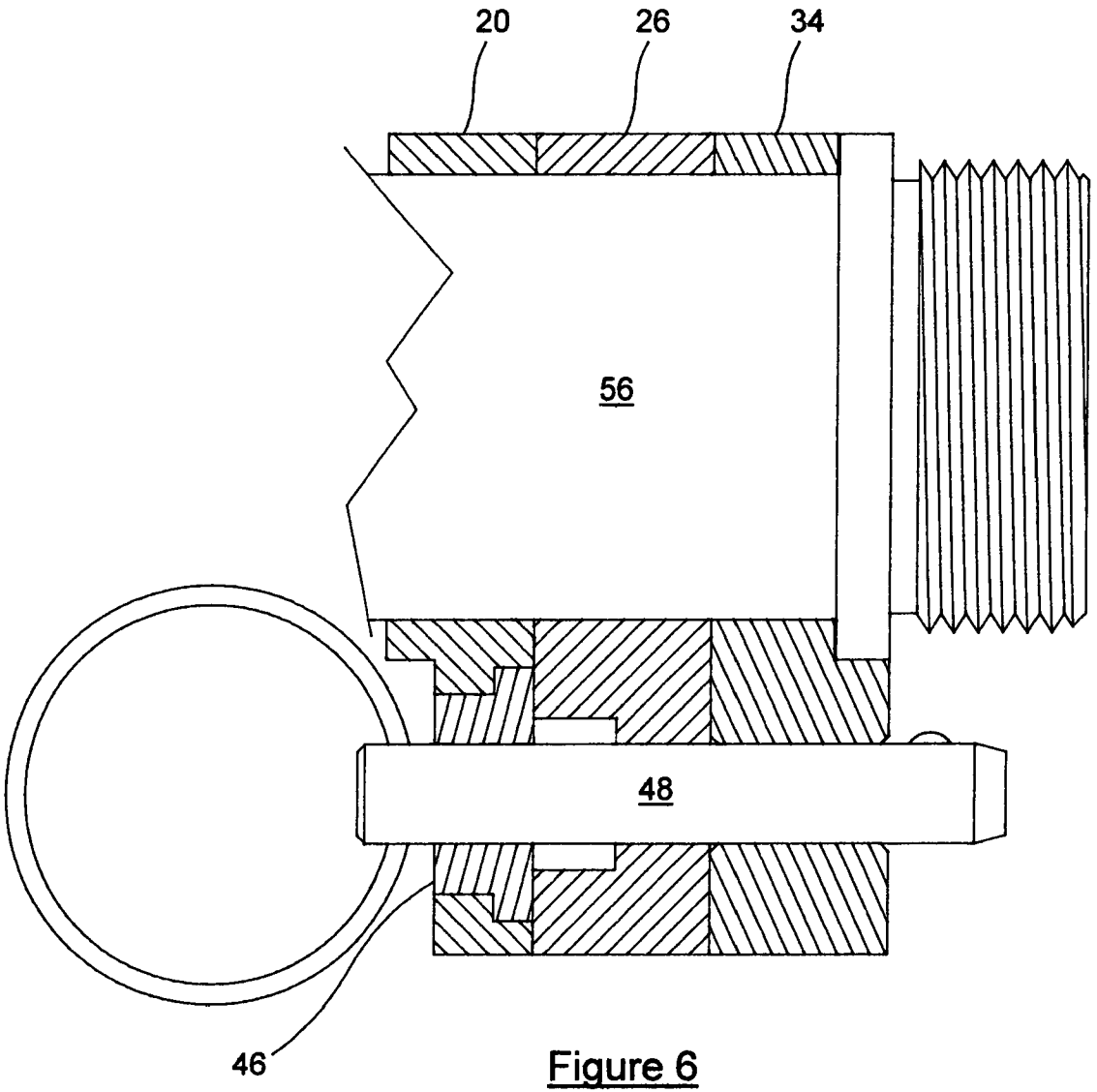
FIG. 6 is a sectional view through the Stock Pivot Adapter with a locking pin in place.

FIG. 6 is similar to FIG. 5, except that it shows a locking pin 48 in position. It is to be understood that when the butt 14 is assembled at different openings 24, it changes the relative available indexing from either extreme left to extreme right or the neutral position.

Although the invention is described primarily with respect to a combat weapon, it is to be understood that the principles would apply to training devices, replicas or other objects that are like-used weapons.

Thus, as can be seen, the present invention permits the user of a shoulder-fired weapon to index the butt of the weapon to varying positions to accommodate comfort and ease while wearing a gas mask, or in the case of needing to have available multiple sight lines, allowing those to be accommodated on a single weapon and providing instant access thereto, or alternatively, in the case of firing from a narrow working envelope, permits rotation of the receiver to redirect protruding pistol grips or magazines to the side offering a thinner and lower weapon profile. This invention may be an after-market item or original equipment, be it separately attached elements as disclosed herein or integrally incorporated into the weapons elements on any shoulder-fired projectile weapon utilizing a sight system or target aiming procedures.

The invention claimed is:

1. An accessory for a shoulder-fired weapon, including a butt, firing mechanism and a barrel, comprising means secured in a position between the butt and the remainder of the weapon, permitting the butt to rotate to indexed positions about an axis substantially parallel to the axis of the barrel, whereby the weapon may be fired with the butt in different positions.

2. A shoulder-fired weapon, including a butt, firing mechanism and a barrel, wherein the butt is pivotably secured to the remainder of the weapon, comprising means for predetermining indexed positions of the butt about an axis parallel to the axis of the barrel, and means for securing the butt relative to the remainder of the weapon in the selected indexed position, whereby the weapon may be fired with the butt in different positions.

3. A versatile shoulder-fired projectile weapon, including a butt, firing mechanism and a barrel, wherein the butt of the weapon may be indexed to varying angular positions about an axis substantially parallel to the axis of the barrel, whereby the weapon may be fired with the butt in different positions.

4. An adapter for use with a shoulder-fired weapon, including a butt, firing mechanism and a barrel, including a receiver extension tube interconnecting the butt to the remainder of the weapon, whereby the butt of the weapon is converted from a fixed position element to an element capable of being indexed to select positions about an axis substantially parallel to the axis of the barrel, whereby the weapon may be fired with the butt in different positions.

* * * * *